United States Patent [19]

Möhring et al.

[11] Patent Number: 4,758,806

[45] Date of Patent: Jul. 19, 1988

[54] ANTENNA EXCITER FOR AT LEAST TWO DIFFERENT FREQUENCY BANDS

[75] Inventors: Günter Möhring, Langenhagen; Reimer Nagel, Hanover, both of Fed. Rep. of Germany

[73] Assignee: kabelmetal electro Gesellschaft mit beschränkter Haftung, Hanover, Fed. Rep. of Germany

[21] Appl. No.: 90,670

[22] Filed: Aug. 28, 1987

[30] Foreign Application Priority Data

Sep. 8, 1986 [DE] Fed. Rep. of Germany ..... 3630501
Oct. 11, 1986 [DE] Fed. Rep. of Germany ..... 3634772

[51] Int. Cl.[4] ..... H01P 5/12

[52] U.S. Cl. ..... 333/135; 333/21 A; 333/137

[58] Field of Search ..... 333/135, 21 A, 21 R, 333/134, 136, 137, 126, 129; 343/756

[56] References Cited

U.S. PATENT DOCUMENTS 3,453,621 7/1969 Roney et al. ..... 333/21 R
3,864,688 2/1975 Hansen et al. ..... 343/756
4,410,866 10/1983 Bui-Hai ..... 333/135
4,491,810 1/1985 Saad ..... 333/21 A X

FOREIGN PATENT DOCUMENTS 2117980 10/1983 United Kingdom .
2166297 4/1986 United Kingdom ..... 333/21 A
2166298 4/1986 United Kingdom ..... 333/21 R

*Primary Examiner*—Eugene R. LaRoche
*Assistant Examiner*—Seung Ham
*Attorney, Agent, or Firm*—Martin A. Farber

[57] ABSTRACT

An antenna exciter for two different frequency bands which consists of two polarization switches (3, 4) arranged axially one behind the other and of a feed horn (5). The polarization switches (3, 4) are circular tubes of different inside diameters, the diameters being the same over the entire length. To each polarization switch (3, 4) there can be connected, spaced axially from each other, two wave guides (6, 7, 8, 9) 90° apart from each other. Opposite the wave guide (9) adjacent the feed horn (5) a stop closed by a short-circuit plate (12) is arranged in the corresponding polarization switch (4). Between the feed horn (5) and the adjacent wave guide (9) and between the points of connection of the two wave guides (8, 9) of the larger polarization switch (4), two axially extending webs lying diametrically opposite each other and of a predetermined dimension are arranged therein.

7 Claims, 1 Drawing Sheet

ANTENNA EXCITER FOR AT LEAST TWO DIFFERENT FREQUENCY BANDS

FIELD AND BACKGROUND OF THE INVENTION

The invention relates to an antenna exciter for at least two different frequency bands, consisting of two tubular polarization switches to each of which two wave guides of rectangular cross section for the guidance of linearly polarized electromagnetic waves are connected, and of a feed horn, both polarization switches having a circular inside cross section, the diameter of the two polarization switches being different, the two polarization switches being arranged without axially intervening space one behind the other, the feed horn being arranged at the free end of the polarization switch having the larger inside diameter, the polarization switch with the smaller inside diameter having a constant inside diameter over its entire length, and the two wave guides being so connected at each polarization switch that the waves fed into same have their plane polarization perpendicular to each other, the two wave guides of the polarization switch having the larger inner diameter being so connected impinging radially on same at two axially spaced places which are 90° apart in circumferential direction that the large axes of their cross section extend in the direction of the axis of the polarization switch (GB-OS No. 2,117,980).

Such antenna exciters are used, for instance, for the illuminating of directional antennas with parabolic reflector for directional communication, satellite communication or radio position finding. They can be used in this connection for the direct illuminating of the reflector or also for the illuminating thereof via a subreflector (Cassegrain principle). In this connection, "illumination" is intended to cover both directions of transmission of the electromagnetic waves and therefore both waves to be radiated and waves to be received.

Polarization switches for the illuminating of reflectors are known, for instance, from U.S. Pat. No. 3,864,688. They serve so to uncouple two linearly polarized electromagnetic waves which have been guided over connected wave guides that they do not interfere with each other. In these known polarization switches there is used for this purpose a circular-cylindrical length of tube into which two wave guides debouch alongside of each other, spaced apart in axial direction. The uncoupling of the two waves is effected by a plurality of pins which are shifted relative to each other or a twisted sheet-metal strip which is arranged in the length of pipe between the points of connection of the two wave guides. In this way a rotation of the one wave by 90° is produced so that the two waves are perpendicular to each other. The need for disturbance-free guidance of two linearly polarized waves of the same frequency band can be satisfied therefore at some expense with this known arrangement.

An antenna exciter for two different frequency bands can be noted from U.S. Pat. No. 4,410,866. It has two polarization switches, each of which is designed for a different frequency band. This antenna exciter can, for instance, guide two waves of a frequency band of 3.7 to 4.2 GHz which are perpendicular to each other—in the following called the "4-GHz band"—and two waves of a frequency band of 5.925 to 6.425 GHz which are perpendicular to each other—in the following called the "6-GHZ band." In the tubular polarization switch for the 4-GHz band which is used in this connection, filters are installed which are intended to act as short circuit for the 4-GHz band so as to prevent a propagation of the waves in the wrong direction. The waves of the 6-GHz band, on the other hand, are not to be disturbed by the filters. The installation of these filters which consist of beryllium oxide and the filters themselves represent a considerable expense. They furthermore require precision manufacture. Between the two polarization switches there is furthermore arranged a conically extending transition piece by which the antenna exciter is made longer and heavier. Installation in an antenna system is thereby made more difficult. Furthermore, this transition piece also requires precision manufacture if no disturbing reflections are to be produced.

In the case of the antenna exciter of the aforementioned GB-OS No. 2,117,980 the two polarization switches are arranged directly one behind the other in axial direction, so that no transition piece is required. The polarization switch of the larger inner diameter has, in the case of this known antenna exciter, two sections of different inside diameters. The two wave guides are connected to respective ones of these sections. The section having the larger inside diameter adjoins the other polarization switch while the section having the smaller diameter passes into the feed horn. By this development and arrangement of the polarization switch having the larger inside diameter not only does its manufacture result in an increased expense but the construction of the entire antenna exciter also becomes expensive since the two polarization switches must be manufactured separately and be assembled with the maintaining of very close tolerances. In addition, to this, the connections for the four wave guides must be provided with transformation stages and stops of complicated design must be present in the inlet openings of the two wave guides connected to the polarization switch having the larger inside diameter. In this way, the manufacture of the antenna exciter as a whole becomes very expensive.

SUMMARY OF THE INVENTION

It is an object of the invention to provide an antenna exciter for at least two different frequency bands which is simple to manufacture and makes it possible, at little expense, to guide four electromagnetic waves without their interfering with one another.

According to the invention, in an antenna exciter of the introductory-described type it is provided that:

also the polarization duplexer (switch) (4) having the larger inside diameter has a constant inside diameter over its entire axial length;

diametrically opposite the point of connection of the wave guide (9) which is lying closest to the feed horn (5) there is arranged within this polarization duplexer (4) a iris (17) which is closed off by a short-circuit plate (12); and between the feed horn (5) and the wave guide (9) adjacent to it, on the one hand, and between the connecting places of the two wave guides (8, 9), on the other hand, there are arranged in this polarization duplexer (4) in each case on two diametrically opposite sides inward protruding and axially extending bars (13–16) whose axial length corresponds approximately to one-half the wave-guide wavelength of the waves guided in the polarization duplexer (switch) (3) of smaller diameter, the two bars (webs) (15, 16) lying between the feed horn (5) and the attachment of the adjacent wave guide (9) in a plane which extends at right angles to the large cross sectional axis of this wave guide (9) while the two bars (webs) (13, 14) lie between the connections of the two wave guides (8, 9) in a plane which extends at right angles to the large cross sectional axis of the wave guide (8) which is connected to the polarization duplexer (4) of larger inside diameter on the side away from the feed horn (5).

Both polarization duplexers of this antenna exciter are of constant inside diameter throughout. Accordingly, they can be very easily manufactured. This, however, is true in particular also for the entire antenna exciter since the two polarization duplexers can be readily made in one piece, both by machining (boring) and galvanically. The four wave guides can be connected via irises of simple development—for instance elongated openings—to the polarization duplexers. The decoupling of the waves of the two different frequency bands is obtained by the short-circuited iris in simple manner, which iris can be produced as simply as the irises of the wave guides. The bars arranged in the larger polarization switch guarantee the good reflection properties of the antenna exciter.

Further according to the invention, the short-circuit plate (12) of the iris (stop) (17) has a distance from the inner wall of the polarization duplexer (4) which corresponds approximately to 0.15 times the wavelength of the middle frequency of the waves guided in said polarization duplexer (4).

Still further by the invention, the axial length of the bars (15, 16) present between the feed horn (5) and the adjacent wave guide (9) is in a ratio to its height, measured from the wall of the polarization duplexer (4), of about 3:1.

Even further according to the invention, the axial length of the bars (13, 14) present between the attachments of the two wave guides (8, 9) is in a ratio to their height, measured from the wall of the polarization duplexer (4), of about 6:1.

Furthermore, diametrically opposite the place of connection of the second wave guide (8) connected at the end away from the feed horn (5), a iris which is closed off by a short circuit plate is also arranged in the polarization duplexer (4) having the larger inside diameter.

BRIEF DESCRIPTION OF THE DRAWING

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

In the following, instead of the expression "antenna exciter" the shorter expression "exciter" will be used for the sake of simplicity, and the shorter word "duplexer" will be used instead of "polarization duplexer."

Figure 1:
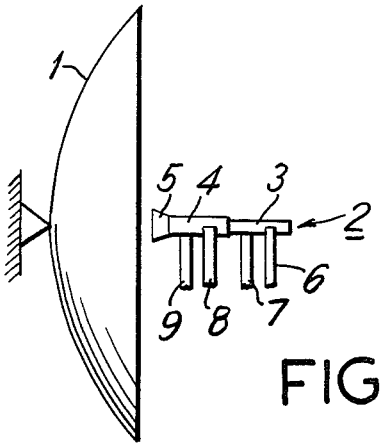
FIG. 1 shows diagrammatically an antenna arrangement with an antenna exciter according to the invention.

1 is the parabolic reflector of an antenna system which is fastened, for instance, on the top of a pole. The exciter 2, which consists of the duplexers 3 and 4 and of the feed horn 5, is arranged in the focal point of the reflector 1. Two rectangular wave guides 6 and 7 debouch into the duplexer 3 while two rectangular wave guides 8 and 9 are connected to the duplexer 4. Mounting and arrangement of the individual parts of the antenna system are known art. Therefore this will not be gone into in detail. In the embodiment shown in FIG. 1, the exciter 2 serves for the direct illuminating of the reflector 1. In principle it is, however, also possible to use the exciter 2 for an antenna system having subreflectors.

Figure 2:
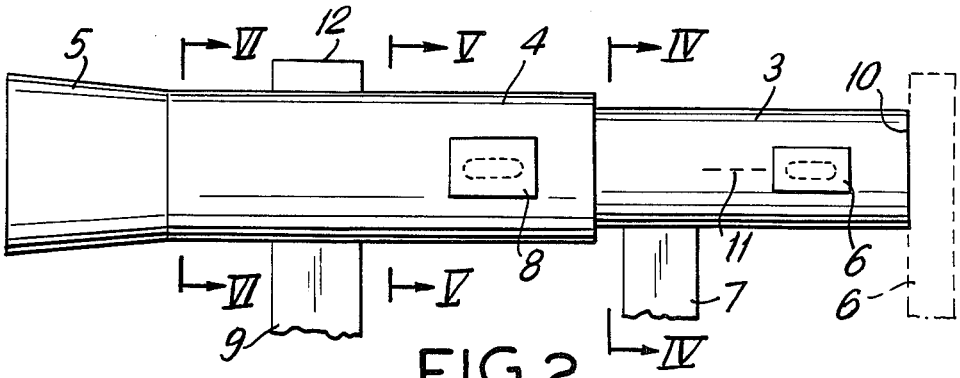
FIG. 2 is the antenna exciter itself, shown on a larger scale.

The two wave guides 8 and 9 debouch at two axially spaced points into the duplexer 4. The points of connection are 90° in circumferential direction from each other. As a result, the planes of polarization of the two waves fed are perpendicular to each other. The two wave guides 6 and 7 can, in principle, enter the duplexer 3 in exactly the same manner, as shown in FIG. 2. However, it is also possible to connect the wave guide 6 to the end of the duplexer 3, as shown in dashed line. In this case also the planes of polarization of the two waves fed via the wave guides 6 and 7 into the switch 3 are perpendicular to each other.

The two duplexers 3 and 4 have a circular inside cross section of constant diameter over their entire length. The dimensions of the duplexer 3 are so selected that two electromagnetic waves which are linearly polarized and perpendicular to each other can be guided in it. The two waves are fed to the duplexer 3 separately via the wave guides 6 and 7. If the wave guide 6 impinges radially on the duplexer 3 then its end 10 is closed. The waves can then propagate only in the direction towards the feed horn 5. In order that the wave fed via the wave guide 7 cannot move in the wrong direction, a known short-circuit element 11, shown in dashed line in the drawing, can be arranged in the duplexer 3. The openings in the duplexer 3 to which the wave guides 6 and 7 are connected have an elongated shape, as indicated in dashed line for the wave guide 6.

The duplexer 4 is, in principle, constructed in precisely the same manner as the duplexer 3. It merely has a larger inside diameter. Over the two connected wave guides 8 and 9 two linearly polarized electromagnetic waves of a different frequency band than in the case of duplexer 3 are fed. The exciter 2 can, for instance, again be designed for the 6-GHz and 4-GHz bands, which have been mentioned above. However, two other different frequency ranges can also be transmitted, for instance the bands of 10.7 to 11.7 GHz and 7.11 to 7.95 GHz, which are mentioned in GB-OS No. 2,117,980. The waves of the higher frequency band are fed into the switch 3 while the waves of the lower frequency band are conducted in the switch 4.

Figure 3:
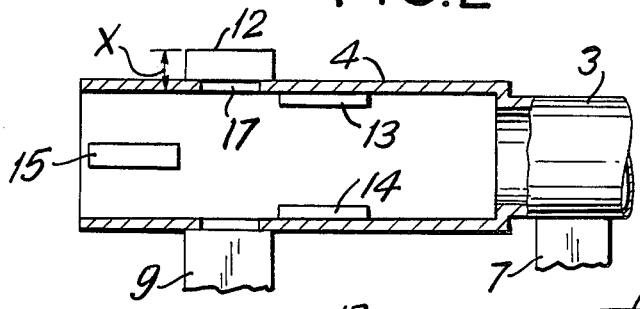
FIG. 3 is a cross section through a part of the antenna exciter.
Figure 4:
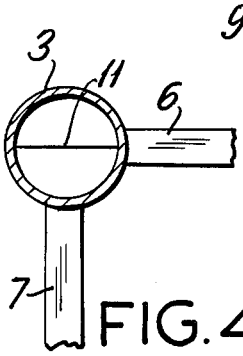
FIG. 4 is a section along the line IV—IV of FIG. 2.
Figure 5:
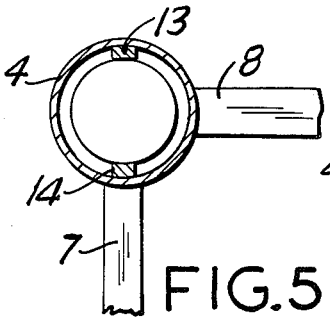
FIG. 5 is a section along the line V—V of FIG. 2.
Figure 6:
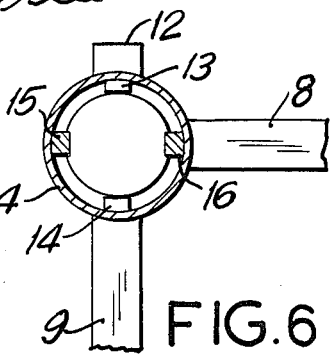
FIG. 6 is a cross section along the line VI—VI of FIG. 2.

Diametrically opposite the point of connection of the wave guide 9, a iris 17, which can be noted in FIG. 3, is arranged in the switch 4, it also being possibly developed as an elongated opening. The iris 17 is closed off by a short-circuit circuit plate 12. The distance "X"

between the short-circuit plate 12 and the inner wall of the duplexer 4 is equal to about 0.15 times the wavelength of the middle frequency of the waves conducted in the duplexer 4.

Between the connection points of the two wave guides 8 and 9 there are arranged, within the duplexer 4, two bars 13 and 14 which extend in axial direction and protrude into the inside the duplexer 4. Two other bars 15 and 16 are arranged between the feed horn 5 and the connection of the wave guide 9 within the duplexer 4. The bars 13 to 16 have an axial length which corresponds approximately to one-half the wave-guide wavelength of the waves guided in the duplexer 3. The height of the webs 13 and 14 over the wall of the duplexer 4 is in a ratio to their length of about 1:6. The two bars 13 and 14 are diametrically opposite each other, in a plane which extends at right angles to the large cross-sectional axis of the wave guide 8. The height of the bars 15 and 16 is in a ratio to their length of about 1:3 so that they extend further into the duplexer 4 than the bars 13 and 14 do. The bars 15 and 16 are also diametrically opposite each other in a plane which extends at right angles to the large cross sectional axis of the wave guide 9.

By the short circuited iris 17 the decoupling of the four waves conducted in the exciter 2 is decisively improved without the otherwise customary irises or balancing elements having to be provided in the duplexers 3 and 4. The good reflection properties of the exciter 2 which are required for a dependable transmission of the waves are assured by the bars 13 to 16.

For certain cases, the decoupling can be further improved in the manner that a short-circuited iris is arranged also on the side of the duplexer 4 which is diametrically opposite the connection of the wave guide 8.

The exciter 2 can be produced as a whole of a single part, namely fundamentally including the feed horn 5. However, preferably only the duplexers 3 and 4 are made in one piece. This can be done preferably galvanically or galvanoplastically. In this connection, it is possible in particularly easy manner also to develop connections for the wave guides 6, 7, 8 and 9 at the same time. The short-circuit plate 12 and another short-circuit plate opposite the wave guide 9 can also in this case be produced at the same time. A part consisting of the duplexers 3 and 4 can, however, also be produced by mechanical machining, in particular by drilling and milling.

We claim:

1. An antenna exciter for at least two different frequency bands, comprising a first and a second tubular polarizing duplexer;

a first group and a second group of two waveguides of rectangular cross section for the guidance of linearly polarized electromagnetic waves connected respectively, to said first and said second duplexers;

both said polarizing duplexers having a circular inside cross section, the inner diameters of the two polarizing duplexers being different such that said second duplexer has a larger inner diameter than said first duplexer, the two polarizing duplexers being arranged contiguously one behind the other, a feed horn being located at a free end of said second polarizing duplexer, said first polarizing duplexer having a constant inside diameter over its entire length; and wherein the two groups of waveguides are connected to the respective polarizing duplexers to feed waves in two perpendicular planes of polarization, the two duplexers having the same two planes of polarization, the two waveguides connected to the second polarizing duplexer being connected at two axially spaced places which are 90 degrees apart in circumferential direction about a longitudinal axis of the polarizing duplexer;

the second polarizing duplexer also has a constant inside diameter over its entire axial length;

diametrically opposite the point of connection of that waveguide which lies closest to the feed horn, there is disposed within the second polarizing duplexer an iris which is closed off by a short-circuit plate; and wherein said exciter comprises a first pair and a second pair of two inwardly projecting bars disposed on said second polarizing duplexer on diametrically opposite sides thereof, respectively, between the feed horn and said closest waveguide, and between the places of connection to said second duplexer of the two waveguides; and wherein the axial length of the two pairs of bars corresponds approximately to one-half the waveguide wavelength of waves guided in the first polarizing duplexer, the two bars of said second pair of bars lying between the feed horn and the site of conenction of said closest lying waveguide in a common plane which extends parallel to the longitudinal axis of said second duplexer and to the longitudinal axis of said closest lying waveguide; and the two bars of the first pair of bars lie between the connections of the two waveguides of the first group in a second common plane which extends at right angles to the first mentioned common plane.

2. An exciter according to claim 1, wherein the short-circuit plate of said iris has a distance from an inner wall of the second polarizing duplexer which corresponds approximately to 0.15 times the wavelength of the middle frequency of waves guided in said second polarizing duplexer.

3. An exciter according to claim 1, wherein the axis length of each of the bars of said second pair of bars is in a ratio to its height, measured from the wall of the polarizing duplexer, of about 3:1.

4. An exciter according to claim 2, wherein the axial length of each of the bars of said second pair of bars is in a ratio to its height, measured from the wall of the polarizing duplexer, of about 3:1.

5. An exciter according to claim 1, wherein the axial length of the bars of said first pair of bars is in a ratio to its height, measured from the wall of the polarizing duplexer, of about 6:1.

6. An exciter according to claim 2, wherein the axial length of the bars of said first pair of bars is in a ratio to its height, measured from the wall of the polarizing duplexer, of about 6:1.

7. An exciter according to claim 1, further comprising a second iris which is closed off by a second short-circuit plate; and wherein said second iris is located in said second duplexer diametrically opposite the place of connection of the second waveguide of said first group of waveguides.

* * * * *